US005251528A

United States Patent [19]

Kurosaki

[11] Patent Number: 5,251,528

[45] Date of Patent: Oct. 12, 1993

[54] SPRING TENSION ADJUSTING APPARATUS FOR HIGH-HAT STAND

[75] Inventor: Makoto Kurosaki, Shizuoka, Japan

[73] Assignee: Yamaha Corporation, Hamamatsu, Japan

[21] Appl. No.: 704,809

[22] Filed: May 23, 1991

[30] Foreign Application Priority Data

May 25, 1990 [JP] Japan ..... 2-54846[U]

[51] Int. Cl.[5] ..... G10D 13/00

[52] U.S. Cl. ..... 84/422.3

[58] Field of Search ..... 84/421, 422.1–422.3

[56] References Cited

U.S. PATENT DOCUMENTS 4,381,690 5/1983 Kimble ..... 84/422 R
4,846,040 7/1989 Hoshino ..... 84/422.1
4,977,810 12/1990 Hsieh ..... 84/422.3
5,018,426 5/1991 Suzuki ..... 84/422.3

FOREIGN PATENT DOCUMENTS 1-152396 10/1989 Japan .

*Primary Examiner*—Bernard Roskoski
*Assistant Examiner*—Jeffrey W. Donels
*Attorney, Agent, or Firm*—Burns, Doane, Swecker & Mathis

[57] ABSTRACT

The present invention relates to a spring tension adjusting apparatus for a high-hat stand, in which operability in tension adjusting of a spring inserted between a cymbal operating shaft and a pipe, and a slide pin for locking one end of spring is engaged with a rotary knob. The rotary knob is pivottary fitted in a lock sleeve fixed to the pipe, thus adjusting the height position of the rotary knob. As a result, spring tension is adjusted by a hand of performer.

15 Claims, 4 Drawing Sheets

SPRING TENSION ADJUSTING APPARATUS FOR HIGH-HAT STAND

BACKGROUND OF THE INVENTION

The present invention relates to a spring tension adjusting apparatus for a high-hat stand, in which operability in tension adjusting of a spring inserted between a cymbal operating shaft and a pipe is improved in such a manner that a slide pin for locking one end of the spring is engaged with a rotary knob, and the rotary knob is pivotally fitted in a lock sleeve fixed to the pipe, thus adjusting the height position of the rotary knob.

A conventional spring tension adjusting apparatus for a high-hat stand of this type is disclosed in, e.g., Japanese Utility Model Laid-Open No. Hei 1-152396.

This apparatus includes an inner cylindrical member in which a cymbal operating shaft is elastically supported through a spring. The tension of the spring is adjusted by adjusting the height position of the inner cylindrical member with respect to an outer cylindrical member thereof. With this tension adjusting, the pressing force of a performer on a foot pedal can be adjusted.

More specifically, a lock pin as a retainer is fixed to the inner cylindrical member. This lock pin is biased downward by the spring and partially protrudes from a vertically elongated hole in the outer cylindrical member.

In addition, a ring-like adjusting member is pivotally supported on the outer cylindrical member. A plurality of stepped portions having different heights are formed on the upper surface of the adjusting member. The above-mentioned lock pin is engaged with one of these stepped portions.

With this arrangement, when the tension of the spring is to be adjusted, the lock pin, which is biased downward, is raised by one hand of the performer to disengage it from the currently engaged stepped portion of the adjusting ring, while the adjusting ring is rotated by the other hand. The height of each stepped portion which is engaged with the lock pin is changed by rotating the adjusting ring, thus adjusting the tension of the spring.

In such a conventional spring tension adjusting apparatus for a high-hat stand, however, when tension adjusting is to be performed, while the lock pin is raised by one hand, the adjusting ring must be rotated by the other hand. That is, tension adjusting always requires both the hands of a performer, resulting in poor operability.

SUMMARY OF THE INVENTION

It is an object of the present invention to provide a spring tension adjusting apparatus for a high-hat stand, which has excellent operability.

It is an object of the present invention to provide a spring tension adjusting apparatus for a high-hat stand, which can be operated by one hand of a performer.

It is an object of the present invention to provide a spring tension adjusting apparatus for a high-hat stand, which can be quickly operated even during a performance.

In order to achieve the above objects, according to the present invention, there is provided a spring tension adjusting apparatus for a high-hat stand, comprising a cylindrical post set on a stand in a vertical position, a cymbal operating member housed in the cylindrical post to be vertically movable, and having a lower end coupled to a footboard through a link, a spring member, having one end locked in the cymbal operating member, for biasing the cymbal operating member upward, a slide pin, which is coupled to the other end of the spring member, and the other end of which is loosely fitted in an elongated hole, formed in the cylindrical post in an axial direction thereof, so as to protrude from the elongated hole, an engaging portion formed around the cylindrical post and including an elongated hole formed to correspond to the elongated hole in the cylindrical post, a plurality of engaging grooves formed in at least a direction to cross an axis of the cylindrical post, and a guide path formed to communicate with the engaging grooves, and a rotary knob rotatably arranged along an outer surface of the engaging portion and including a lock portion for locking the other end of the slide pin protruding from the elongated hole with a biasing force of the spring member, and a positioning projection to be engaged with the guide path and the engaging grooves.

In the spring tension adjusting apparatus for a high-hat stand according to the present invention, each positioning project is engaged with one of the plurality of engaging grooves by rotating the rotary knob. As a result, the position of the rotary knob in relation to the axial direction of the sleeve is changed, and the height position of the slide pin in relation to the cylindrical post is changed. In this case, since the rotary knob can be rotated without disengaging the slide pins from the rotary knob, the tension of the spring can be adjusted by one hand of a performer. That is, since the slide pins are always engaged with the pin engaging portions of the rotary knob, the height position of the rotary knob can be freely changed by simply rotating it by the hand.

DESCRIPTION OF THE PREFERRED EMBODIMENT

An embodiment of present invention will be described below with reference to the accompanying drawings.

FIGS. 1 to 11 are views for explaining a spring tension adjusting apparatus for a high-hat stand.

Figure 1:
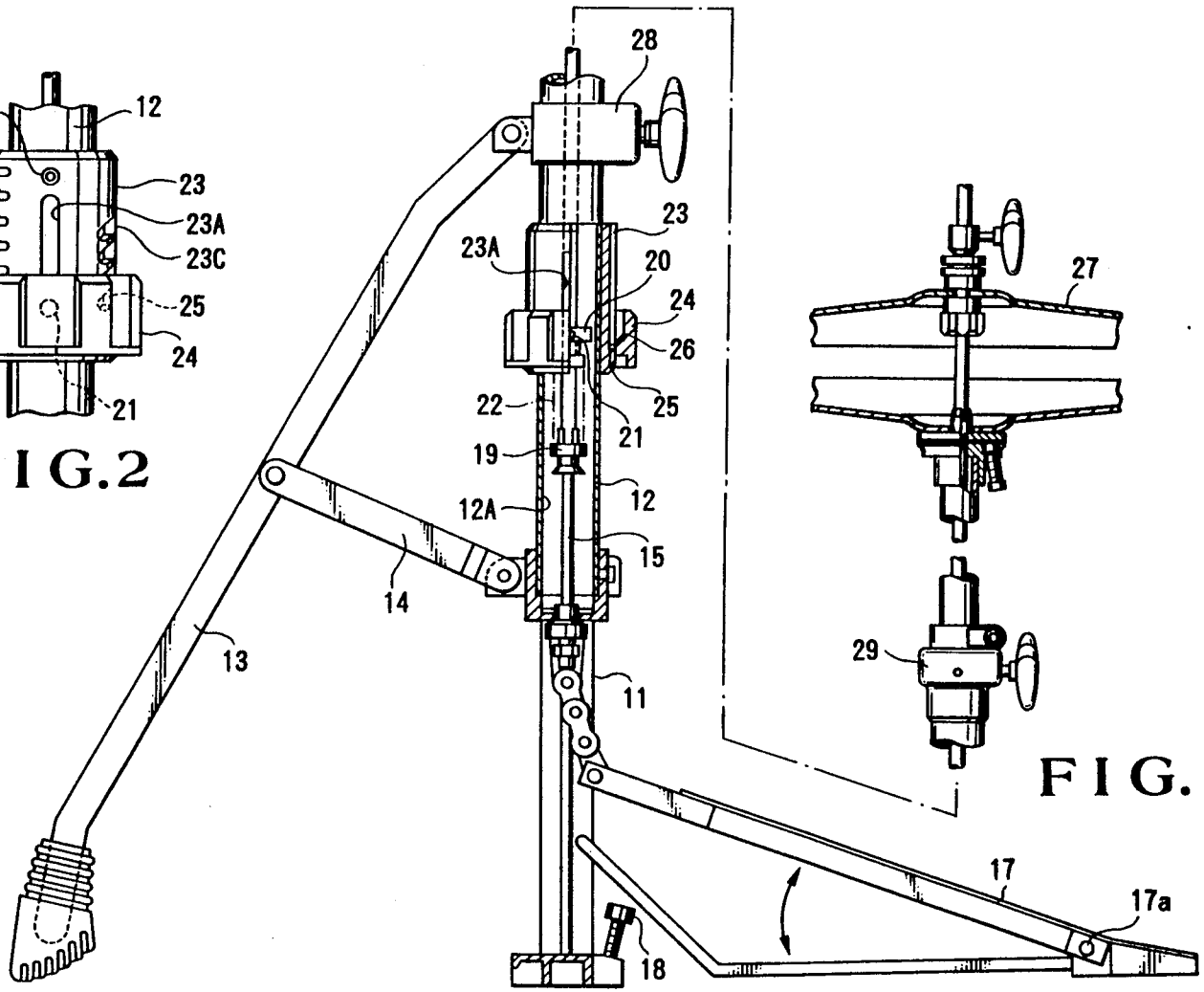
FIG. 1 is a front view showing a spring tension adjusting apparatus for a high-hat stand according to an embodiment of the present invention.

Referring to FIG. 1, reference numeral 11 denotes a frame set in a vertical position. A cylindrical pipe 12 is coupled to the upper end portion of the frame 11 to be held in a vertical position.

The upper end portion of a leg 13, one of the legs of a tripod, is coupled to the upper end portion of the pipe 12. The leg 13 is inclined (set in an extended state) against the pipe 12 and the frame 11 which are vertical to the floor, thus holding them in a vertical position. Reference numeral 14 denotes a support stay for coupling the middle portion of the leg 13 to the lower end portion of the pipe 12.

That is, the pipe 12 constitutes a post supported upright on a stand constituted by the frame 11, the legs 13, and the like.

A cymbal operating shaft 15 is loosely inserted into an internal space 12A of the pipe 12. This cymbal operation shaft 15 is held by the pipe 12 through the upper portion of the frame 11 so as to be freely moved in the vertical direction. Cymbals 27 are fixed to the upper end portion of the cymbal operating shaft 15. Reference numeral 28 denotes an angle adjusting reach for adjusting the inclination angle of the leg 13; and 29, a height adjusting reach for adjusting the height of the cymbals 27.

The lower end portion of the cymbal operation shaft 15 extends downward through a hole in the frame 11 to be coupled to the distal end of a footboard (pedal) 17. The footboard 17 freely pivots on a proximal end portion 17*a*, which is separated from the frame 11, in the direction indicated by an arrow in FIG. 1. When the footboard 17 is pressed by the foot, the cymbal operation shaft 15 is moved downward to cause the high-hat cymbals to produce a sound. Note that reference numeral 18 denotes a stopper of the frame 11.

In this case, a retainer (spring bush) 19 is fixed to a lower portion of the cymbal operating shaft 15. A spring bush 20 is loosely fitted on a portion, of the cymbal operating shaft 15, which is located higher than the fixing portion of the retainer 19 by a predetermined height.

Figure 10:
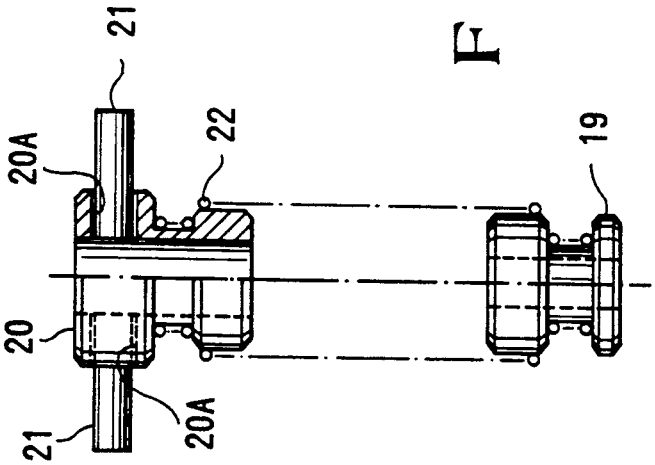
FIG. 10 is a partially sectional view showing part of a spring assembly in FIG. 1.

As shown in detail in FIG. 10, a pair of holes 20A are formed in the spring bush 20 at symmetrical positions to extend in a direction perpendicular to the axis of the spring bush 20. A pair of slide pins (retainer pins) 21 are respectively inserted and fixed in the holes 20A. Note that only one slide pin 21 may be used.

In addition, a coil spring (tension spring) 22 is inserted between the retainer 19 and the spring bush 20 to always bias the cymbal operating shaft 15 upward.

More specifically, the coil spring 22 is wound around the cymbal operating shaft 15, while the lower and upper ends of the coil spring 22 are respectively fixed to the retainer 19 and the spring bush 20. Since the upper end of the coil spring 22 is fixed to the spring bush 20 in this manner, the upper end is locked by the slide spring 21.

Figure 11:
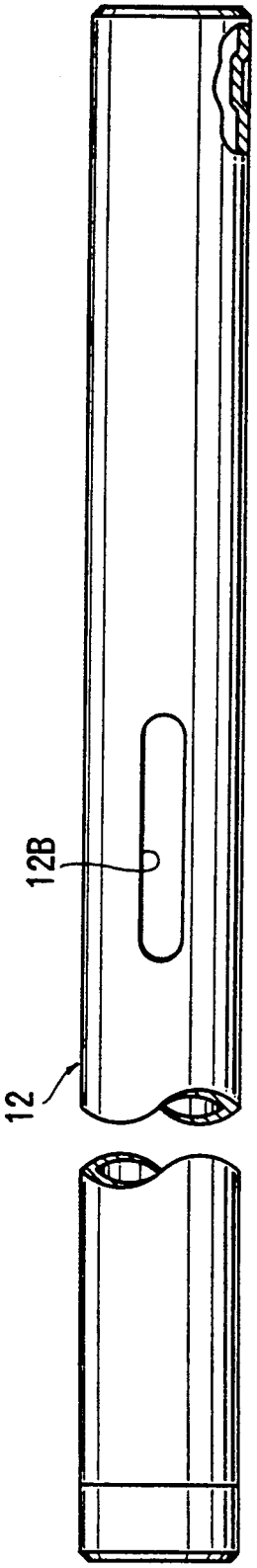
FIG. 11 is a front view showing a pipe in FIG. 1.

An elongated hole 12B is formed in a portion, of the pipe 12, which corresponds to a loosely fitting portion of the spring bush 20 so as to extend in the axial direction of the pipe 12 (vertical direction) by a predetermined length (corresponding to a desired spring adjustment width) (see FIG. 11).

Figure 2:
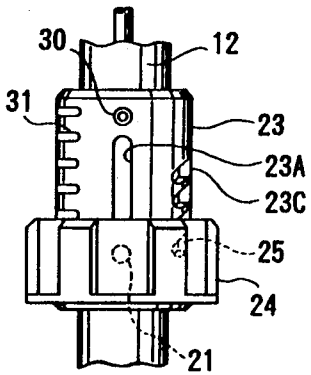
FIG. 2 is an enlarged front view showing a main part of the spring tension adjusting apparatus for the high-hat stand in FIG. 1.
Figure 3:
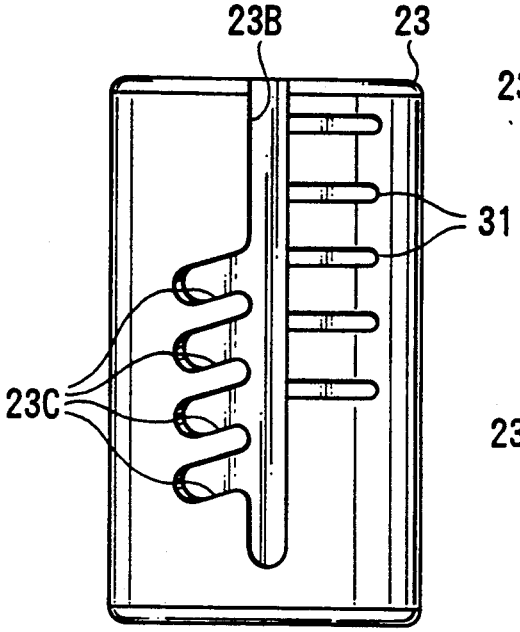
FIG. 3 is a front view showing a sleeve in FIG. 1.
Figure 4:
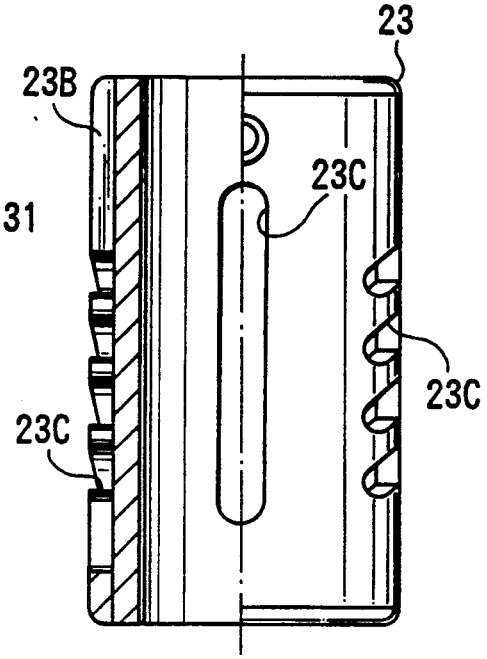
FIG. 4 is a partially sectional view showing the sleeve in FIG. 1.
Figure 5:
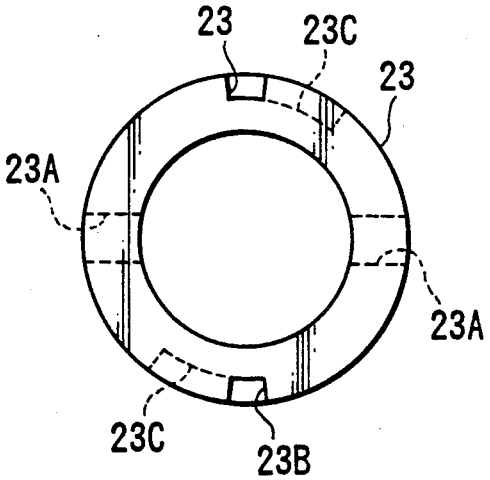
FIG. 5 is a plan view showing the sleeve in FIG. 1.
Figure 6:
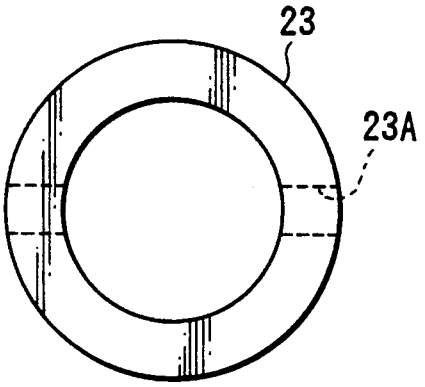
FIG. 6 is a bottom view showing the sleeve in FIG. 1.
Figure 9:
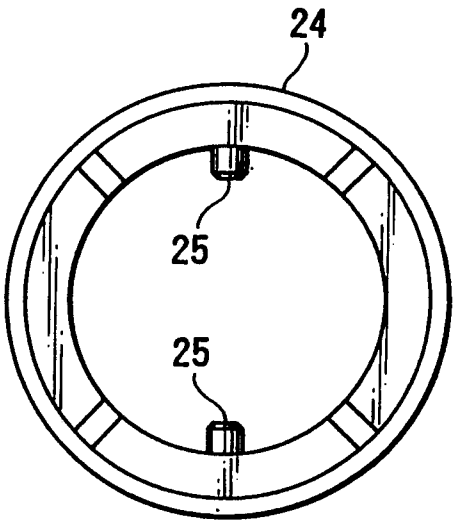
FIG. 9 is a bottom view showing the rotary knob in FIG. 1.
Figure 8:
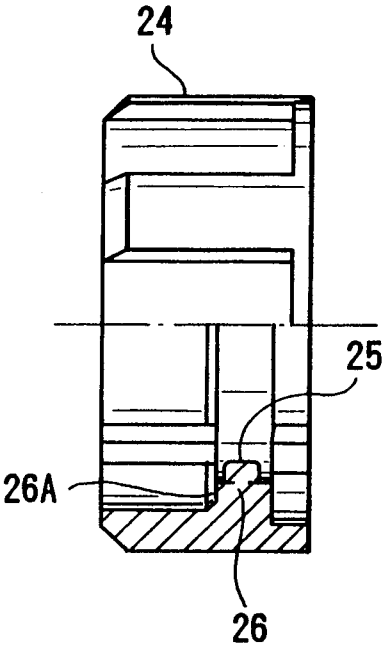
FIG. 8 is a sectional view taken along a line VIII—VIII in FIG. 7.
Figure 7:
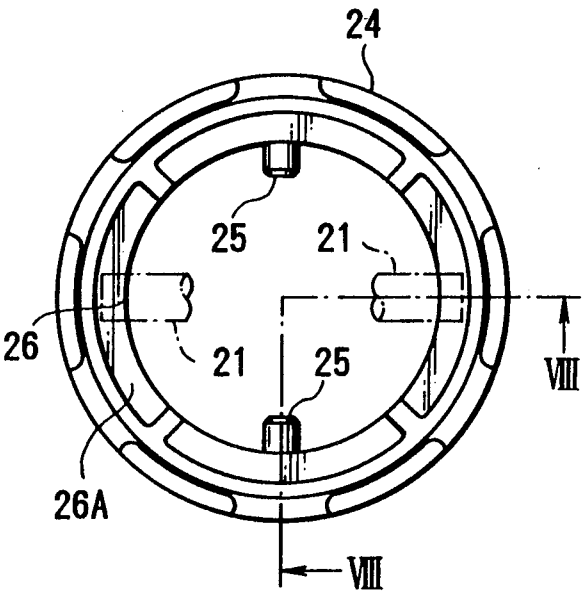
FIG. 7 is a plan view showing a rotary knob in FIG. 1.

Furthermore, as shown in FIG. 2, a lock sleeve 23 is fitted on the elongated-hole-forming portion of the pipe 12 and is fixed thereto with a screw 30. An elongate hole 23A is also formed in the lock sleeve 23, as shown in FIG. 4 (a partially cutaway view equivalent to FIG. 3 upon rotation of FIG. 3 through 90° counterclockwise). The lock sleeve 23 is fitted on the pipe 12 such that the elongated hole 23A overlaps the elongated hole 12B.

The horizontal protruding distal end portions of the slide pins 21 are loosely fitted in the overlapping elongated holes 12B and 23A to extend outward from the pipe 12.

A rotary knob 24 is pivotally fitted on the lock sleeve 23. As shown in detail in FIGS. 7 to 9, this rotary knob 24 has a ring-like shape as a whole. A pair of projections 25 are symmetrically formed on the inner surface of the knob 24 to extend inward by a predetermined length. These projections 25 may be integrally formed with the lock sleeve 23 or may be constituted by screws or the like. In addition, stepped portions 26 are formed on inner surface portions, of the rotary knob 24, which correspond to the portions where the projections 25 are formed. The stepped portions 26 extend inward from the inner surface portions.

More specifically, the stepped portion 26 respectively constitute pin engaging portions with which the protruding portions of the slide pins 21, which protrude from the elongated holes 12B and 23A, are brought into contact and engaged. The slide pins 21 are respectively biased by the spring 22 to be brought into contact and engaged with upper annular horizontal surfaces 20A of the stepped portions 26.

As shown in detail in FIGS. 3 to 6, vertical grooves 23B as guide paths are formed in the outer surface of the lock sleeve 23 to have open upper ends and extend vertically. A plurality of (four) inclined grooves 23C, each having the same depth as that of the vertical groove 23, are arranged along the axial direction of each vertical groove 23B. Note that the lower end of each vertical groove 23 may be open. If the two ends of each vertical groove 23 are open, a stopper may be arranged as needed.

The projections 25 of the rotary knob 24 are inserted-/engaged in/with the inclined grooves 23C and the vertical groove 23B. The height position of the rotary knob 24 (in relation to the lock sleeve 23) is set by selectively engaging the projections 25 with the inclined grooves 23C. Reference numeral 31 denotes a scale whose marks are recorded in correspondence with the position of the upper end face of the rotary knob 24.

Each of the pair of vertical grooves 23B constitutes a guide path along which a corresponding one of the positioning projections 25 of the rotary knob 24 can be guided to either one of the plurality of inclined grooves 23C when the rotary knob 24 is rotated. Note that each inclined groove 23C extends upward at an angle of about 75° with respect to the vertical groove 23B so as to cross it, as shown in FIG. 3.

In the spring tension adjusting apparatus having the above-described arrangement, therefore, the tension of the coil spring 22 is adjusted by adjusting the height position of the retainer on one side of the coil spring 22, i.e., the slide pin 21 in the pipe 12.

More specifically, the spring tension is reduced in the following manner. The rotary knob 24 is rotated about the axis through a predetermined angle to move the projections 25 from the inclined grooves 23C to the vertical grooves 23B. The projections 25 are slid downward along the vertical grooves 23B. Thereafter, the rotary knob 24 is rotated in the reverse direction to engage the projections 25 with, e.g., the lowermost inclined grooves 23C.

As a result, the spring length of the spring assembly is decreased (initial load reduction), and the spring tension is reduced.

In contrast to this, when the spring tension is to be increased, the following operation is performed. Similar to the above-described operation, the rotary knob 24 is rotated to disengage the projections 25 from the lower inclined grooves 23C and are moved upward along the vertical grooves 23B. The projections 25 are then engaged with, e.g., the uppermost inclined grooves 23C. As a result, the spring length of the spring assembly is increased (initial load increase), and the spring tension is increased.

Such a spring tension adjusting operation can be very easily performed by slidably rotating the rotary knob 24 by one hand of a performer. This is because the coil spring 22 is always in contact and engaged with the stepped portions 26 of the rotary knob 24 during the pivotal movement of the rotary knob 24.

In addition, this spring tension adjusting can be realized by a simple arrangement as a whole.

Figure 12:
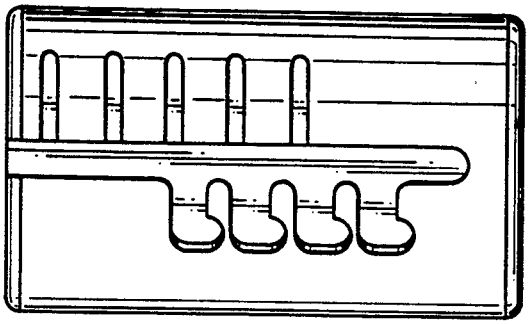
FIG. 12 is a front view showing a sleeve according to a second embodiment.

Note that the inclined grooves 23C with which the projections of the lock sleeve 23 are engaged may be inclined downward or may extend horizontal. In addition, as shown in FIG. 12 if each inclined groove 23C is formed into an inverted L-shaped groove consisting of a substantially horizontal guide portion continuous with the vertical groove 23B and an engaging portion bending downward from the guide portion, the lock function of the groove is enhanced to improve the reliability of a height position setting operation. This is because the projections are not easily disengaged from the inclined grooves (engaging grooves).

Although the lock sleeve 23 is arranged independently of the pipe 12, they may be integrally formed. In this case, the elongated holes 12B and 23A are formed as a single elongated hole.

Furthermore, in this embodiment, the coil spring 22 is constituted by a tension spring. However, a compression spring may be used in such a manner that its initial load is adjusted at the engaging position of the slide pin 21.

As has been described above, according to the present invention, spring tension adjusting can be performed with one hand of a performer, and hence a adjusting operation is greatly facilitated. Therefore, spring tension adjusting can be quickly performed. For example, the tension of the spring can be easily adjusted even during a performance.

If the retainer is arranged above the spring bush, and the spring is inserted therebetween, the spring can be used for compression.

What is claimed is:

1. A spring tension adjusting apparatus for a high-hat stand, comprising:

a cylindrical post set on a stand in a vertical position;

a cymbal operating member housed in said cylindrical post to be vertically movable and having a lower end coupled to a footboard through a link;

a spring member, having one end locked in said cymbal operating member, for biasing said cymbal operating member upward;

a slide pin, one end of which is coupled to the other end of said spring member, and the other end of which is loosely fitted in an elongated hole, formed in said cylindrical post in an axial direction thereof, so as to protrude from said elongated hole;

an engaging portion formed around said cylindrical post and including an elongated hole formed to correspond to said elongated hole in said cylindrical post, a plurality of engaging grooves formed in at least a direction to cross an axis of said cylindrical post, and a guide path formed to intersect said engaging grooves; and a rotary knob having a ring-like shape arranged along an outer surface of said engaging portion for partial rotation about said cylindrical post and including a lock portion for locking the other end of said slide pin protruding from said elongated hole with a biasing force of said spring member, and a positioning projection for engagement with said guide path and said engaging grooves.

2. An apparatus according to claim 1, wherein said engaging portion is a sleeve fixed to a portion, of said cylindrical post, at which said two elongated holes overlap.

3. An apparatus according to claim 1, wherein said lock portion is a stepped portion extending from an inner ring-like surface portion of said rotary knob.

4. An apparatus according to claim 1, wherein said positioning projection is constituted by a pair of projections symmetrically arranged on inner surface portions of said rotary knob to extend inward by a predetermined length, and said engaging grooves and said guide path are symmetrically formed in an outer surface of said cylindrical post in correspondence with said pair of projections.

5. An apparatus according to claim 1, wherein said engaging grooves are grooves inclined downward.

6. An apparatus according to claim 1, wherein each of said engaging grooves includes a substantially horizontal guide portion continuous with said guide path, and an engaging portion bending downward from said guide portion.

7. An apparatus according to claim 1, wherein a scale indicating reference values of spring tension is marked on portions of said engaging portion at which said slide pin is engaged with said engaging grooves.

8. An apparatus according to claim 1, wherein said spring member is a tension spring.

9. An apparatus according to claim 1, wherein said spring member is a compression spring.

10. An apparatus according to claim 1, wherein said positioning projection is a screw.

11. An apparatus according to claim 1, further comprising a spring bush to which the other end of said spring member and said slide pin are fixed, said spring bush being loosely fitted in said cymbal operating member.

12. An apparatus according to claim 1, wherein said slide pin is constituted by a pair of symmetrical pins, and said elongated hole in said cylindrical post and said elongated hole in said engaging portion are integrally formed at symmetrical positions to constitute a pair in correspondence with said pair of pins.

13. An apparatus according to claim 4, wherein said engaging grooves are substantially horizontal.

14. An apparatus according to claim 13, wherein to adjust tension of the spring member, said rotary knob is partially rotated to move said positioning projection in a first direction from a first of said engaging grooves into said guide path and said rotary knob is substantially rotated to move said positioning projection in a second direction, opposite said first direction, from said guide path into a second of said engaging grooves.

15. An apparatus according to claim 4, wherein said positioning projection of said rotary knob is rotatable within said engaging grooves and is vertically slidable, without rotation, in said guide path.

* * * * *